US009267354B2

(12) United States Patent
Watson

(10) Patent No.: US 9,267,354 B2
(45) Date of Patent: Feb. 23, 2016

(54) FLUID INJECTION DEVICE

(75) Inventor: Peter Watson, Cambridgeshire (GB)

(73) Assignee: Camcon Oil Limited, Cambridgeshire (GB)

( * ) Notice: Subject to any disclaimer, the term of this patent is extended or adjusted under 35 U.S.C. 154(b) by 398 days.

(21) Appl. No.: 13/879,810

(22) PCT Filed: Oct. 19, 2011

(86) PCT No.: PCT/GB2011/052024

§ 371 (c)(1),
(2), (4) Date: Apr. 17, 2013

(87) PCT Pub. No.: WO2012/052760

PCT Pub. Date: Apr. 26, 2012

(65) Prior Publication Data

US 2013/0199797 A1 Aug. 8, 2013

(30) Foreign Application Priority Data

Oct. 20, 2010 (GB) ..... 1017699.8

(51) Int. Cl.
*E21B 34/06* (2006.01)
*E21B 43/12* (2006.01)
(Continued)

(52) U.S. Cl.
CPC ..... *E21B 34/066* (2013.01); *E21B 43/12* (2013.01); *E21B 43/14* (2013.01); *E21B 43/20* (2013.01); *E21B 43/162* (2013.01)

(58) Field of Classification Search
CPC ..... E21B 34/066; E21B 34/06; E21B 43/162; E21B 43/20; E21B 34/00; E21B 34/10
See application file for complete search history.

(56) References Cited

U.S. PATENT DOCUMENTS 4,711,304 A 12/1987 Boeke et al.
5,176,164 A * 1/1993 Boyle ..... 137/155
(Continued)

FOREIGN PATENT DOCUMENTS

GB 2 452 858 A 3/2009
WO 99/04137 A1 1/1999
(Continued)

OTHER PUBLICATIONS

United Kingdom Intellectual Property Office, Patents Act 1977: Search Report under Section 17, Application No. GB1017699.8, dated Apr. 18, 2011 (2 pages).
(Continued)

*Primary Examiner* — Brad Harcourt
(74) *Attorney, Agent, or Firm* — Wood, Herron & Evans, LLP

(57) ABSTRACT

A fluid injection device (38) for deployment in a well-bore to control injection of fluid into an oil reservoir, wherein the well-bore has an outer pipe (16) and an inner tube (14) which extends within the outer pipe and is connected at one end to a pressurized fluid supply above the ground. The device includes a control valve arrangement comprising: an inlet (42) for receiving the fluid from the inner tube; an outlet (56) for outputting the fluid outside the inner tube; an inlet valve (44) in a fluid path between the inlet and the outlet; and an actuator (50) associated with the inlet valve which is controllable to switch the inlet valve between its open and closed configurations, such that when the inlet valve is open, the fluid flows from the inner tube, via the inlet, fluid path and outlet to outside the inner tube. A method of controlling injection of fluid into an oil reservoir from a well-bore using such a device is also provided.

13 Claims, 4 Drawing Sheets

(51) Int. Cl.

| | |
|---|---|
| ***E21B 43/14*** | (2006.01) |
| ***E21B 43/20*** | (2006.01) |
| *E21B 43/16* | (2006.01) |

(56) References Cited

U.S. PATENT DOCUMENTS

| | | | | |
|---|---|---|---|---|
| 5,873,414 | A * | 2/1999 | von Gynz-Rekowski | 166/319 |
| 6,491,098 | B1 | 12/2002 | Dallas | |
| 2002/0027004 | A1 | 3/2002 | Bussear et al. | |
| 2009/0014168 | A1 * | 1/2009 | Tips et al. | 166/73 |
| 2009/0229824 | A1 * | 9/2009 | Ocalan et al. | 166/303 |
| 2010/0096127 | A1 | 4/2010 | Jordy | |

FOREIGN PATENT DOCUMENTS

| | | | |
|---|---|---|---|
| WO | 2008/091345 | A1 | 7/2008 |
| WO | 2009/147446 | A2 | 12/2009 |

OTHER PUBLICATIONS

European Patent Office, International Search Report and Written Opinion of the International Searching Authority, International Application No. PCT/GB2011/052024, dated Feb. 15, 2013 (12 pages).

* cited by examiner

FLUID INJECTION DEVICE

BACKGROUND OF THE INVENTION

When oil is discovered it is not uncommon for more than one reservoir to be discovered, with one below the other. This may have been because they were formed at different times in history or because at some time oil was able to move up through a permeable layer which later moved and stopped the flow.

To reduce the costs of recovering oil from each reservoir, a single oil well may be created that passes through each reservoir so that oil can be recovered from each simultaneously. This method of creating two or more producing wells from a single casing is called a dual- or multi-completion well. A diagram of such a well is shown in FIG. 1, which extends below the surface (S) of the ground and intercepts both reservoirs R1 and R2.

As the two reservoirs have developed in different environments and at different times, it is likely that they will have different characteristic pressures and temperatures which can compromise the extraction process. This can be exacerbated over time as the volume of oil remaining in one of the wells may reduce much quicker, and therefore the pressure will drop quicker leading to a lower rate of oil production.

Engineers have developed several tools to overcome this and one approach is called "stimulation", where the reservoir pressure is increased by some means, one of which is water injection. This method involves injection of water directly into a particular reservoir to replace the lost oil and thus increase the reservoir pressure. As water is heavier than oil it does not easily mix with the oil and therefore sinks to the bottom of the reservoir (see water layer W in FIG. 2) allowing oil production to continue at an increased pressure.

Currently water injection wells are either specially drilled and created for this specific purpose or use a converted oil well. A schematic of such a well can be seen in FIG. 3. A separate water injection well is required for each well to enable the water supply to each to be controlled independently. If a well has more than one producing reservoir, the implementation of water injection therefore becomes significantly more complex and expensive.

SUMMARY OF THE INVENTION

The present invention provides a fluid injection control device for deployment in a well-bore to control injection of fluid into an oil reservoir, wherein the well-bore has an outer pipe and an inner tube which extends within the outer pipe and is connected at one end to a pressurized fluid supply above the ground, and the device includes a control valve arrangement comprising:

- an inlet for receiving the fluid from the inner tube;
- an outlet for outputting the fluid outside the inner tube;
- an inlet valve in a fluid path between the inlet and the outlet; and
- an actuator associated with the inlet valve which is controllable to switch the inlet valve between its open and closed configurations, such that when the inlet valve is open, the fluid flows from the inner tube, via the inlet, fluid path and outlet to outside the inner tube.

The invention further provides a method of controlling injection of fluid into an oil reservoir from a well-bore, wherein the well-bore has an outer pipe and an inner tube which extends within the outer pipe and is connected at one end to a pressurized fluid supply above the ground, the method comprising the steps of:

- installing a first fluid injection control device as defined above with its inlet in fluid communication with the inner tube; and
- selectively operating the actuator so as to inject the fluid outside the inner tube.

BRIEF DESCRIPTION OF THE DRAWINGS

Known techniques and embodiments of the invention will now be described by way of example and with reference to the accompanying schematic drawings, wherein.

DETAILED DESCRIPTION OF THE INVENTION

Figure 1:
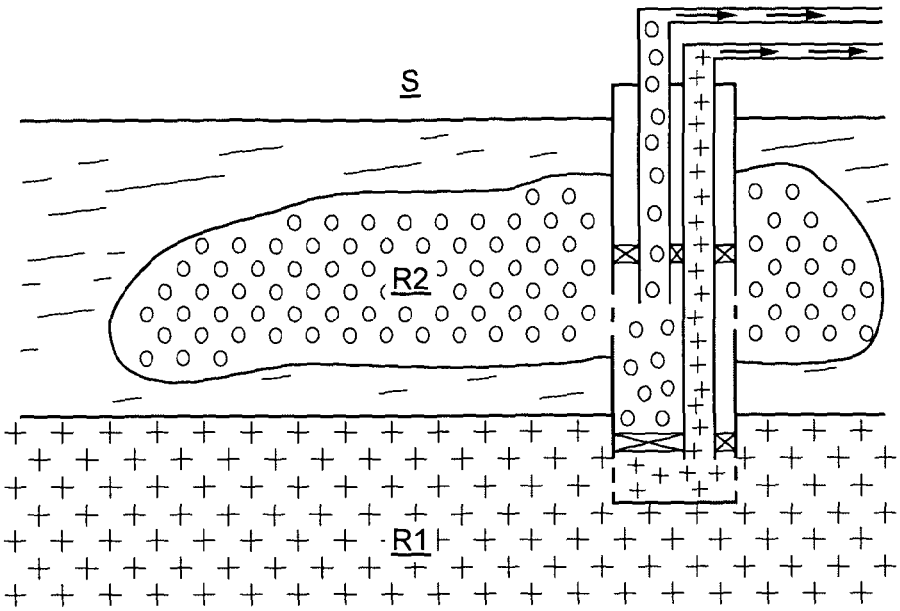
FIGS. 1 to 3 are cross-sectional views of oil wells to illustrate known water injection techniques.
Figure 2:
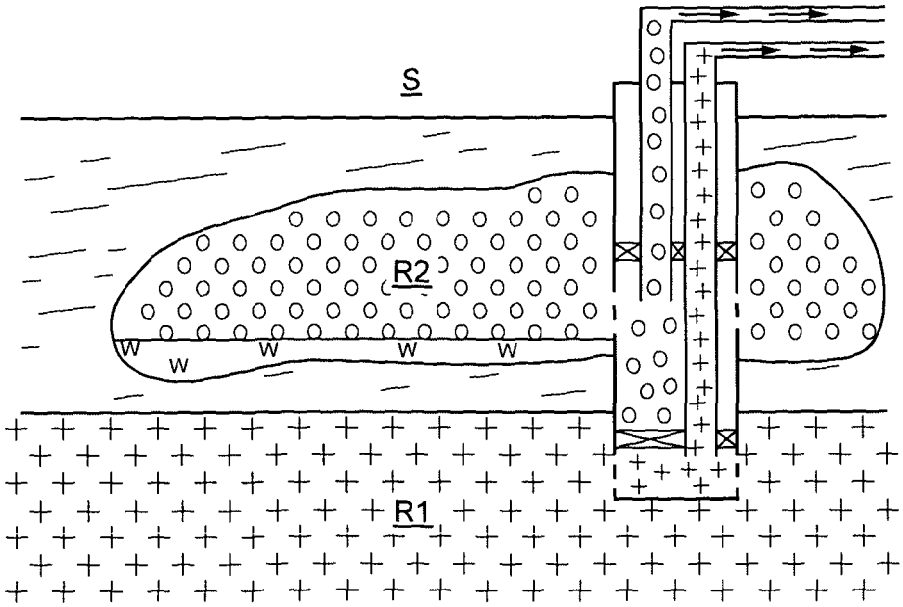
Figure 3:
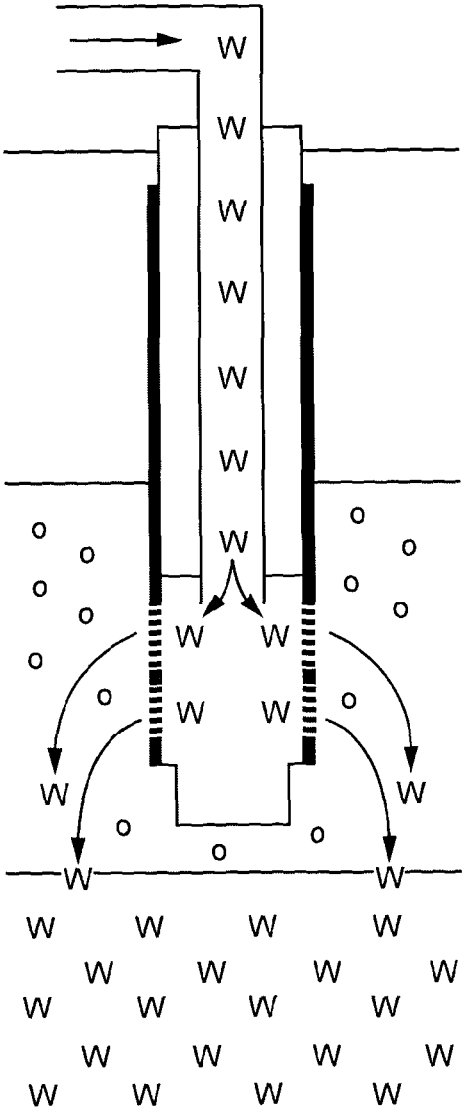

Embodiments of the present invention facilitate the implementation of multi-zonal injection from a single production tubing string. Moreover they may allow the rate of injection into each zone to be controlled independently of the pressure of the injected water. A schematic diagram of such a implementation is shown in FIG. 4.

A device embodying the invention incorporates an electrically actuatable valve (or valves) into the tubing string and allows water to pass from the inner, centre tube (working pipe) into the outer pipe. Two such devices 10 and 12 are deployed in tubing string 14 in the example of FIG. 4. The tubing string is provided within an outer pipe 16, and together they define an elongated annular region 18 between them. The outer pipe has perforations 20 to allow fluid to flow from the annular region to the surrounding rock formation.

Two injection zones 22 and 24 are defined in the annular region by packers 26 and 28. The packers prevent fluid flow between the zones. An injection device 10, 12 is located in a respective zone 22, 24. The perforations associated with zone 22 permit fluid flow into a first oil reservoir R1, and similarly the perforations associated with zone 24 permit fluid flow into a second oil reservoir R2. Oil is extracted from the reservoirs R1 and R2 via a separate well 30.

Figure 4:
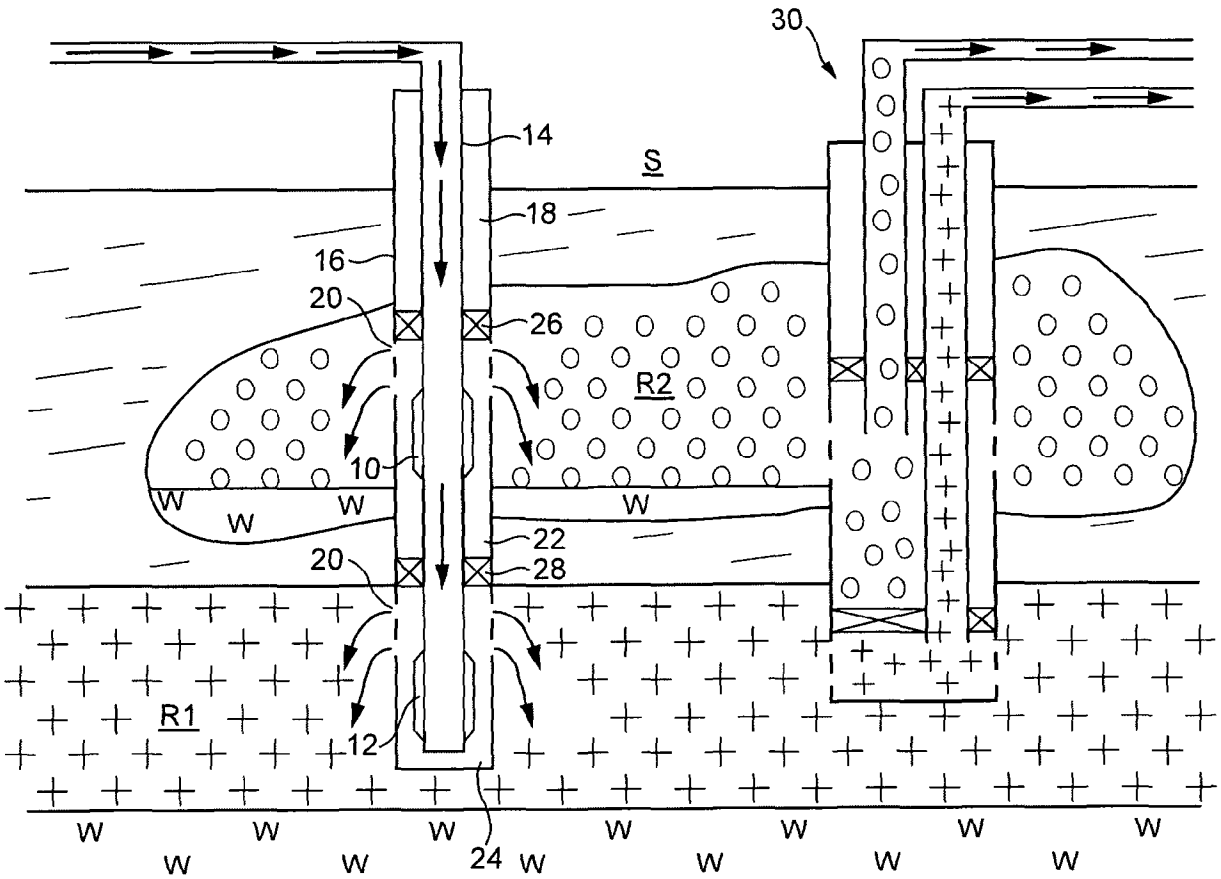
FIG. 4 is a cross-sectional view of an oil well to illustrate an embodiment of the invention.

In operation of the arrangement shown in FIG. 4, water is pumped under pressure into the tubing string 14. The water is selectively and independently permitted to flow into each zone 22, 24 via respective fluid injection devices 10, 12. The water then passes from each zone via the perforations 20 into the adjacent reservoir. Each device may include two or more valves which are independently actuatable using respective electrically switchable actuators. Thus the flow rate from each device is controllable independently of the other device(s) associated with the same tubing string by selecting which valves to open in each device.

Figure 5:
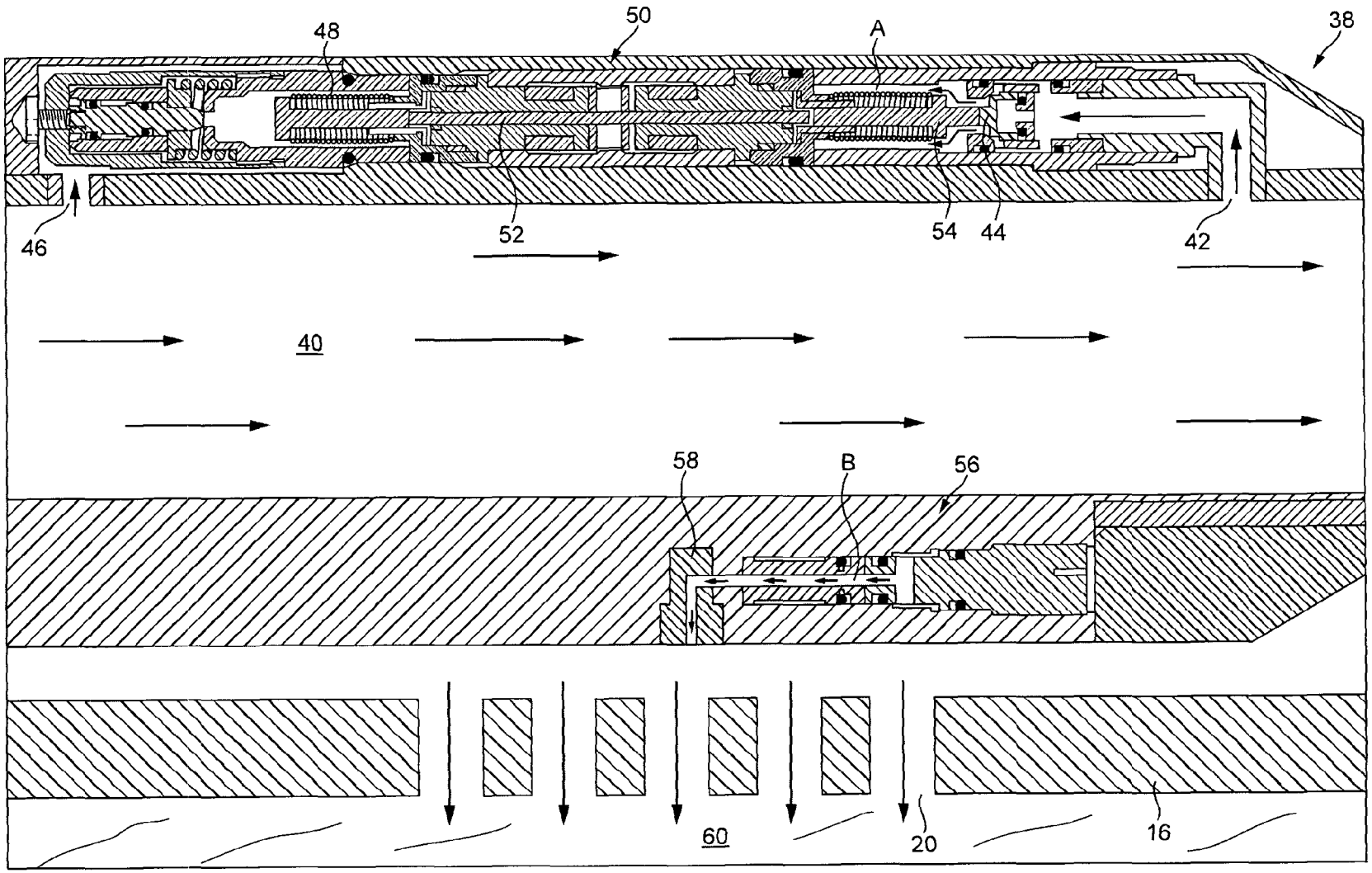
FIG. 5 is a longitudinal cross-sectional view of part of a fluid injection control device embodying the invention.

A diagram of a fluid injection device 38 embodying the invention is shown in FIG. 5. The configuration illustrated is similar to that of a gas lift device described in International Publication No. WO 2009/147446 (filed by the applicant), the content of which is incorporated herein by reference, but it incorporates a number of different features in accordance with embodiments of the present invention.

Water under pressure is supplied to the centre pipe 40 and it flows into the small inlet hole 42 and passes to the valve 44. The water also enters the small inlet hole 46 so that equal pressure is present at both the valve and the rear bellows 48 of the actuator 50. The pressure is therefore balanced across the actuator.

When the unit is actuated, the actuator impeller 52 pushes pin 54 which in turn opens valve 44. This allows fluid to pass through the valve and travel from point A to point B in the outlet 56 via a fluid conduit in the device (not shown). As the fluid passing through the valve is equal in pressure to that in the tubing and it presses on the front bellows of the actuator, the system remains in balance. The fluid travelling through the outlet then passes into the outer pipe via injection orifice 58. The outer pipe is perforated by perforations 20 and therefore allows the fluid to enter the reservoir 60. The fluid flow can be stopped by actuating the valve 44 in the opposite direction by sending an appropriate control signal to the actuator 50.

The device may include externally removable injection orifices 58 so that flow rates can be readily selected according to particular field conditions by choosing appropriate orifice sizes for insertion in the device.

For the purposes of illustration, the valve 44 and outlet 56 are shown on opposite sides of the device in FIG. 5. It will be appreciated that in practice they can be located adjacent to each other.

The device may also incorporate a pressure sensor for monitoring the pressure in the annular region adjacent to the injection device. This parameter can be used to influence the fluid flow rate to the or each reservoir.

The provision of more than one such valve in an injection control device allows the operator to have a finer control on the flow rate of the fluid. This concept is not limited to injection of water and could be used in the injection of gases as well.

Advantages of this arrangement include:

1. The implementation of dual or multi-zonal wells is made simpler as they can be achieved with a single well bore, reducing the size of the drilling and casings used and reducing the complexity of the implementation.
2. Pressures at different depths can be managed by changing the injection orifice sizes and/or having multiple valves that can be opened and closed to manage flow rates.
3. The actuator is preferably an electrically switchable (and preferably bistable) actuator which is held in one of its stable states without consuming electrical power. It may be retained in a selected state by means of internally generated mechanical and/or magnetic forces only, requiring only a short electrical pulse to switch it to another state. This means that the injection device can be deployed down a well for long periods of time without reliance on a constant supply of power from the surface or downhole batteries. Suitable actuator configurations are described for example in United Kingdom Patent Nos. 2342504 and 2380065, International Patent Publication No. WO 2009/147446 and U.S. Pat. No. 6,598,621, the contents of which are incorporated herein by reference.

The invention claimed is:

1. A fluid injection control device for deployment in a well-bore to control injection of fluid into an oil reservoir, wherein the well-bore has an outer pipe and an inner tube which extends within the outer pipe and is connected at one end to a pressurized fluid supply above the ground, and the device includes a control valve arrangement comprising:

an inlet for receiving the fluid from the inner tube;

an outlet for outputting the fluid outside the inner tube;

an inlet valve in a fluid path between the inlet and the outlet; and an actuator associated with the inlet valve which is controllable to switch the inlet valve between its open and closed configurations, such that when the inlet valve is open, the fluid flows from the inner tube, via the inlet, fluid path and outlet to outside the inner tube, wherein the inlet valve is mechanically coupled to one end of an impeller of the actuator, and the other end of the impeller is coupled to the pressure in the inner tube, to substantially equalise the external pressure acting on each end of the actuator.

2. A device of claim 1, wherein the actuator has two stable states in which the inlet valve is held in its open and closed configurations, respectively.

3. A device of claim 1 including at least two of the control valve arrangements, the arrangements having respective actuators which are independently controllable.

4. A device of claim 3, wherein at least two control valve arrangements are provided which are configured such that when the respective inlet valves are in their open configurations, the arrangements would output fluid at different flow rates to each other at their outlets with their inlets connected to the same fluid supply.

5. A device of claim 4, wherein the output flow rate from at least one of the control valve arrangements for a given fluid supply is adjustable.

6. A device of claim 5, wherein a portion of the device which defines part of the fluid path between the inlet and outlet of the at least one control valve arrangement can be substituted via an external wall of the device to alter the flow restriction created by that portion of the fluid path.

7. A device of claim 1, wherein the device is configured for deployment around the inner tube.

8. A device of claim 1, wherein the device is arranged to be coupled in use between two portions of the inner tube so that it defines a path for the fluid between the two portions.

9. A device of claim 1, including a safety valve in the fluid path between its outlet and the inlet valve, with the safety valve arranged to inhibit fluid flow into the device via its outlet.

10. A device of claim 1 including a pressure sensor for monitoring the fluid pressure outside the inner tube.

11. A device of claim 1 wherein the actuator is an electrically switchable actuator.

12. A method of controlling injection of fluid into an oil reservoir from a well-bore, wherein the well-bore has an outer pipe and an inner tube which extends within the outer pipe and is connected at one end to a pressurized fluid supply above the ground, the method comprising the steps of:

installing a first fluid injection control device of claim 1 with its inlet in fluid communication with the inner tube; and selectively operating the actuator so as to inject the fluid outside the inner tube.

13. A method of claim 12, including the steps of:

installing a second fluid injection device of claim 1 with its inlet in fluid communication with the inner tube; and selectively operating the actuator of the second device so as to inject the fluid outside the inner tube at a different location to the first device.

* * * * *